US008430392B2

(12) United States Patent
Nada et al.

(10) Patent No.: US 8,430,392 B2
(45) Date of Patent: Apr. 30, 2013

(54) SHEET CONVEYING APPARATUS AND IMAGE FORMING APPARATUS

(75) Inventors: Takao Nada, Numazu (JP); Atsushi Kawarago, Suntou-gun (JP); Taku Nishikawa, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/422,060

(22) Filed: Mar. 16, 2012

(65) Prior Publication Data

US 2012/0242029 A1 Sep. 27, 2012

(30) Foreign Application Priority Data

Mar. 24, 2011 (JP) ..... 2011-066001

(51) Int. Cl.
*B65H 7/02* (2006.01)

(52) U.S. Cl.
USPC ..... 271/10.12; 271/10.11; 271/242

(58) Field of Classification Search ..... 271/3.2, 271/4.1, 10.11, 10.12, 242, 272, 251, 273, 271/274, 21, 225
See application file for complete search history.

(56) References Cited

U.S. PATENT DOCUMENTS

| | | | | |
|---|---|---|---|---|
| 3,954,261 | A * | 5/1976 | Greene et al. | 271/188 |
| 5,465,953 | A * | 11/1995 | Takemoto et al. | 271/234 |
| 8,215,638 | B2 * | 7/2012 | Nieda et al. | 271/240 |
| 2004/0178571 | A1 * | 9/2004 | Ohama et al. | 271/272 |

FOREIGN PATENT DOCUMENTS

JP 7-117899 5/1995

* cited by examiner

*Primary Examiner* — Jeremy R Severson
(74) *Attorney, Agent, or Firm* — Fitzpatrick, Cella, Harper & Scinto

(57) ABSTRACT

In order to provide a sheet conveying apparatus and an image forming apparatus capable of alleviating a bumping noise generated between a sheet and an inner guide member when the sheet passes through a curved sheet conveying path, a pair of intermediate conveying rollers is arranged in positions corresponding to both lateral sides in a width direction of the feeding roller and subsidiary feeding roller in a sheet conveyance direction. In addition, the subsidiary intermediate conveying roller abuts on the intermediate conveying roller with an inclination such that the sheet conveyance force is directed to the center of the sheet conveying path in a width direction. As a result, the sheet makes contact with the inner guide member of the facing guide member of the sheet conveying path by undulating the sheet in a width direction when the sheet is extracted and conveyed by the pair of intermediate conveying rollers.

6 Claims, 9 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus, and more particularly, to a configuration for alleviating a bumping noise generated between a sheet and an inner guide member of a sheet conveying path when the sheet passes through the curved sheet conveying path.

2. Description of the Related Art

In the related art, in an image forming apparatus for forming an image on a sheet such as a recording sheet using an electrophotographic system, an image is obtained by transferring a toner image (visible image) carried on a photosensitive drum or a transfer body onto a sheet such as plain paper conveyed from a sheet cassette. In such an image forming apparatus of the related art, the direction of a leading end of the sheet may be rotated at a slight angle with respect to a sheet conveyance direction, that is, skew feeding may occur in the sheet during a feeding operation for feeding the sheet from the sheet cassette or during the conveyance of the sheet. If such skew feeding occurs in the sheet, the image formed on the sheet through a transfer process and a fixing process is curved relative to the sheet.

In this regard, in the image forming apparatus of the related art as disclosed in Japanese Patent Laid-Open No. 07-117899, the skew feeding of the sheet is corrected using a registration roller so as to improve the accuracy of the image forming position. However, such an image forming apparatus of the related art includes a curved sheet conveying path having an outer guide member and an inner guide member facing each other. In addition, an intermediate conveying roller and a registration roller are arranged in the sheet conveying path to convey the sheet fed from the feeding roller.

Here, in a case where the sheet conveyance velocity of the intermediate conveying roller is set to be slightly slower than that of the registration roller, the sheet is pressed against the inner guide member and stretchingly conveyed while the sheet is nipped by both the registration roller and the intermediate conveying roller. As a result, the conveyance resistance of the sheet increases, and the sheet conveyance accuracy of the registration roller is degraded.

In this regard, in the related art, the sheet conveyance velocity of the intermediate conveying roller is set to be slightly faster than that of the registration roller. With such a velocity relationship between two rollers, the sheet is conveyed to the outer guide member in a bent state without being pressed against the inner guide member while the sheet is nipped by both the registration roller and the intermediate conveying roller. Since the sheet is conveyed without being pressed against the inner guide member, the conveyance resistance to the sheet is alleviated, and the sheet conveyance accuracy to the registration roller may be improved.

However, in the image forming apparatus of the related art, the sheet is conveyed to the outer guide member in a bent state due to a difference of the sheet conveyance velocity between the registration roller and the intermediate conveying roller as described above. Here, if the sheet is conveyed in this manner, the sheet is conveyed only by the registration roller as soon as the trailing end of the sheet passes through the nip of the intermediate conveying roller.

However, if the sheet is conveyed only by the registration roller, the sheet bent toward the outer guide member rapidly approaches the inner guide member and bumps against the inner guide member, resulting in a bumping noise.

In this manner, if the sheet conveyance velocity of the intermediate conveying roller is set to be slightly faster than that of the registration roller to increase a sheet conveyance velocity in the registration roller, the sheet bumps against the inner guide member after the trailing end of the sheet passes through the nip of the intermediate conveying roller. As a result, a bumping noise is generated.

In this regard, the invention has been made to address such problems and provides a sheet conveying apparatus and an image forming apparatus capable of alleviating the bumping noise generated between the sheet and the inner guide member when the sheet passes through the curved sheet conveying path.

SUMMARY OF THE INVENTION

The present invention provides a sheet conveying apparatus including a first sheet conveying portion including a rotating member configured to convey a sheet, a second sheet conveying portion that is arranged on downstream of the first sheet conveying portion, includes a plurality of pairs of rotating members provided in a width direction perpendicular to a sheet conveyance direction, and conveys the sheet from the first sheet conveying portion using the plurality of pairs of the rotating members, and a sheet conveying path that includes an outer guide member and an inner guide member facing each other and is curved to guide the sheet conveyed by the second sheet conveying portion to a downstream side, wherein the plurality of pairs of the rotating members of the second sheet conveying portion are arranged in positions corresponding to both lateral sides in a width direction of the rotating member of the first sheet conveying portion in a sheet conveyance direction when the sheet is conveyed by the second sheet conveying portion, and a sheet conveyance force caused by the plurality of pairs of the rotating members of the second sheet conveying portion is directed to a center of the sheet conveying path in a width direction.

According to the invention, the sheet is caused to undulate in the width direction while the sheet is being conveyed and thus the sheet is allowed to make contact with the inner guide member of the curved sheet conveying path. Accordingly, the bumping noise generated between the sheet and the inner guide member can be reduced when the sheet passes through the sheet conveying path.

Further features of the present invention will become apparent from the following description of exemplary embodiments with reference to the attached drawings.

DESCRIPTION OF THE EMBODIMENTS

Figure 1:
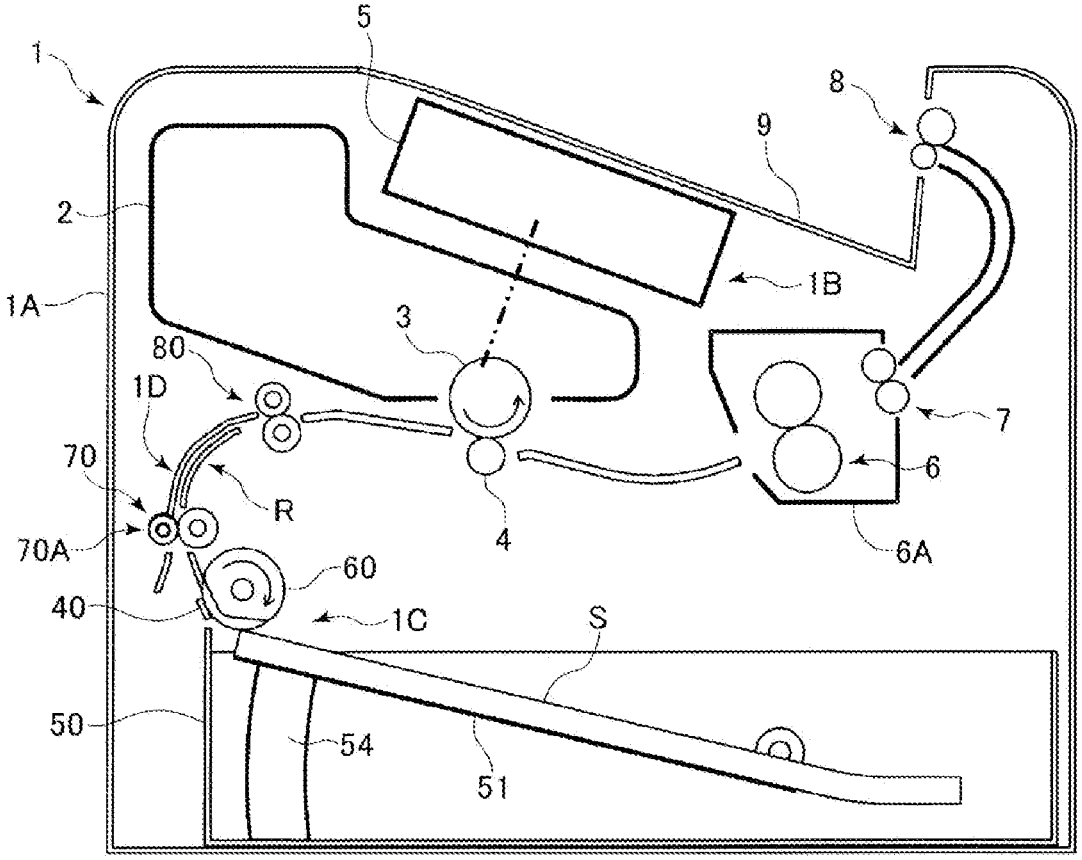
FIG. 1 is a diagram illustrating a schematic configuration of a laser beam printer as an example of an image forming apparatus having a sheet conveying apparatus according to an embodiment of the invention.

Hereinafter, exemplary embodiments of the invention will be described in detail with reference to the accompanying drawings. FIG. 1 is a diagram illustrating a schematic configuration of a laser beam printer as an exemplary image forming apparatus according to an exemplary embodiment of the invention. Referring to FIG. 1, the laser beam printer 1 includes a laser beam printer mainframe 1A (hereinafter, referred to as an apparatus mainframe) and an image forming portion 1B. A sheet feeding apparatus 1C for feeding the sheet to the image forming portion 1B is provided under the apparatus mainframe 1A. In addition, the apparatus mainframe 1A is provided with a sheet conveying apparatus 1D for conveying the sheet fed from the sheet feeding apparatus 1C to the image forming portion 1B.

The image forming portion 1B includes a cartridge unit 2 having a photosensitive drum 3 as an image bearing member and a laser scanner 5 for exposing the photosensitive drum 3. In addition, when an image is formed, the photosensitive drum 3 is exposed using the laser scanner 5 to form a latent image on the surface of the photosensitive drum, and then, the latent image is developed so as to form a toner image on the surface of the photosensitive drum.

In addition, the sheet feeding apparatus 1C includes a sheet cassette 50 as a sheet loading portion detachably attachable to the apparatus mainframe 1A and a feeding roller 60 provided over the sheet cassette 50 to output the sheet S stored in the sheet cassette 50. In addition, a sheet supporting plate 51 for supporting the sheets and pressing the sheet S against the feeding roller side is provided in the sheet cassette 50 so as to be lifted and lowered. During the sheet feeding, the sheet S is pressed against the feeding roller 60 by a sheet supporting plate pressing spring 54 provided under the sheet supporting plate 51. In addition, the sheet feeding apparatus 1C includes a separation pad 40 which serves as a frictional separation member for isolating the sheet S output by the feeding roller 60 in press contact with the feeding roller 60.

Figure 2:
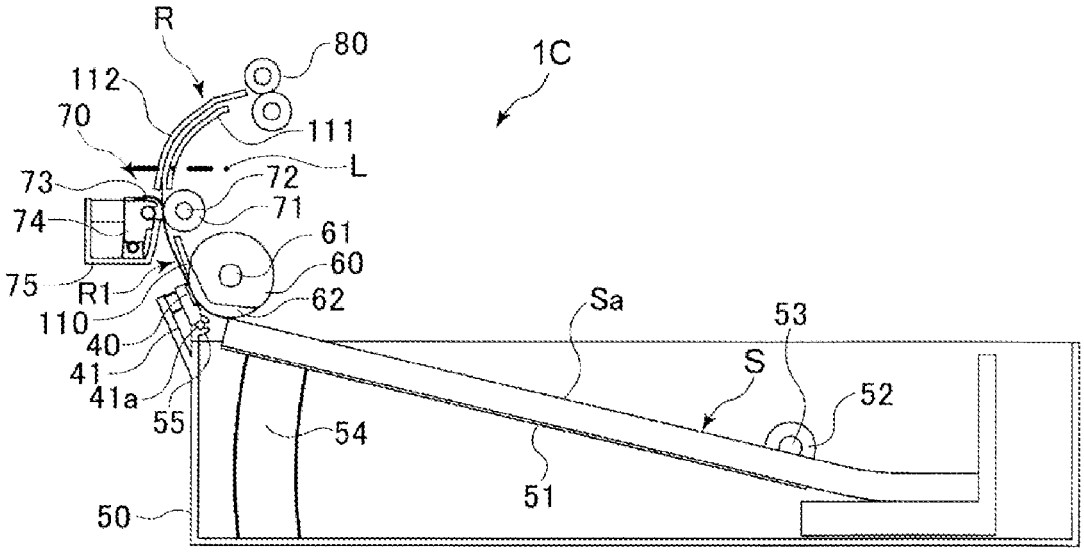
FIG. 2 is a diagram illustrating a configuration of the sheet feeding apparatus provided in the laser beam printer.

FIG. 2 is a diagram illustrating a configuration of the sheet feeding apparatus 1C. The sheet supporting plate 51 is supported to the sheet cassette 50 pivotably (liftably) in a vertical direction by a sheet supporting plate pivot hole 52 and a sheet supporting plate pivot axis 53 provided in the sheet cassette 50. In addition, the feeding roller 60 is installed in a roller shaft 61 which is rotatably driven by a driving unit (not illustrated). In both sides of the feeding roller 60, the subsidiary feeding rollers 62 are rotatably installed in the roller shaft 61. In addition, a driving force is not transmitted to the subsidiary feeding roller 62.

Referring to FIG. 2, a separation pad holder 41 for holding the separation pad 40, a separation pad holder pivot axis 41*a* is pivotably supported by a separation pad holder bearing 55 provided in the sheet cassette 50. In addition, the separation pad 40 makes press contact with the feeding roller 60 or the subsidiary feeding roller 62 by a separation pad spring 42 through the separation pad holder 41. Generally, the feeding roller 60, the separation pad 40, and the intermediate conveying roller 71 are formed of a high frictional member (such as rubber).

Figure 3A:
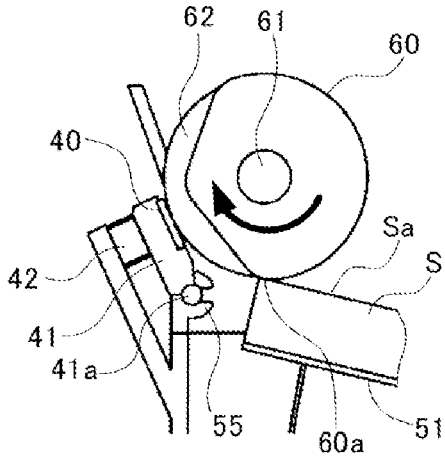
FIG. 3A is a diagram illustrating a sheet feeding operation of the sheet feeding apparatus.

However, the external shape of the feeding roller 60 is not circular but has a fanning shape obtained by partially notching the peripheral surface. Meanwhile, the subsidiary feeding roller 62 coaxially arranged in both sides of the feeding roller 60 in a width direction has a circular shape, and the outer diameter of the subsidiary feeding roller 62 is slightly smaller than the outer diameter of the arc of the feeding roller 60. Here, as the sheet supporting plate 51 is lifted, an uppermost sheet Sa loaded on the sheet supporting plate 51 first abuts on the subsidiary feeding roller 62. Then, as the feeding roller 60 is integrally rotated along with the roller shaft 61, a protrusion 60*a* of the feeding roller 60 makes contact with the uppermost sheet Sa as illustrated in FIG. 3A. Then, the sheet Sa is output as the feeding roller 60 rotates in an arrow direction.

Figure 3B:
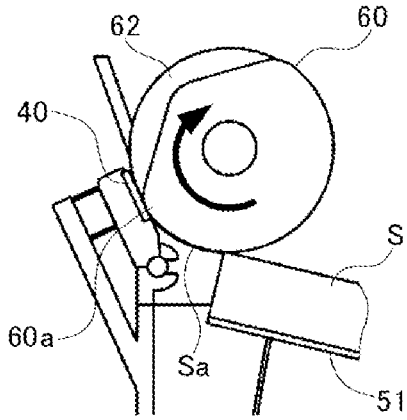
FIG. 3B is a diagram illustrating a sheet feeding operation of the sheet feeding apparatus.
Figure 3C:
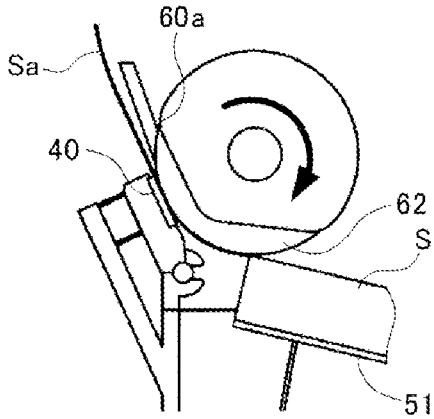
FIG. 3C is a diagram illustrating a sheet feeding operation of the sheet feeding apparatus.

Then, as illustrated in FIG. 3B, as the protrusion 60*a* arrives at the position facing the separation pad 40, the sheet S overlappingly output along with the uppermost sheet Sa is isolated by the separation pad 40. Then, as the protrusion 60*a* moves to the position not facing to the separation pad 40, the subsidiary feeding roller 62 abuts on the uppermost sheet Sa, and the frictional force of the feeding roller 60 is not applied to the fed sheet Sa. At this moment, the sheet Sa is nipped between the separation pad 40 and the subsidiary feeding roller 62. Then, the feeding roller 60 stops at the standby position illustrated in FIG. 3C at the timing when the sheet Sa is conveyed to a pair of intermediate conveying rollers 70 in preparation for the next sheet feeding.

As illustrated in FIG. 1, the sheet conveying apparatus 1D includes a pair of registration rollers 80 for performing skew feeding correction for the sheet fed from the sheet feeding apparatus 1C and then conveying the sheet to a transfer portion including the photosensitive drum 3 and a transfer roller 4 at a predetermined timing. In addition, the sheet conveying apparatus 1D includes a second sheet conveying portion 70A provided in a curved sheet conveying path R to convey the sheet fed from the sheet feeding apparatus 1C of a first sheet conveying portion to the pair of registration rollers 80.

The second sheet conveying portion 70A includes a pair of intermediate conveying rollers 70 as a plurality of pairs of rotating members provided in the width direction perpendicular to the sheet conveyance direction. According to the present embodiment, a conveyance velocity of the pair of intermediate conveying rollers 70 is set to be faster than a conveyance velocity of the pair of registration rollers 80.

Next, description will be made for a sheet feeding operation of the sheet feeding apparatus 1C and a sheet conveying operation of the sheet conveying apparatus 1D configured as described above. The sheet feeding apparatus 1C outputs the sheet S stored in the sheet cassette 50 through the sheet feeding operation of FIG. 3 along with the image forming operation of the image forming portion 1B described above and then isolates the sheet S one by one using the separation pad 40 which makes press contact with the feeding roller 60.

In addition, the sheet conveying apparatus 1D conveys the sheet S fed one by one from the sheet feeding apparatus 1C to the pair of registration rollers 80 through a plurality of pairs of intermediate conveying rollers 70 provided in the second sheet conveying portion 70A provided in the downstream side of the sheet feeding apparatus 1C. Then, the sheet is conveyed to a transfer portion having the photosensitive drum 3 and the transfer roller 4 at a predetermined timing through the pair of registration rollers 80 provided on the downstream side of the second sheet conveying portion 70A.

In the transfer portion, a toner image formed on the surface of the photosensitive drum is transferred to the sheet S conveyed to the transfer portion. Then, the sheet is conveyed to a fixing unit 6A and is heated and pressed by a pair of fixing rollers 6 provided in the fixing unit 6A to fix the toner image. After the image is fixed in this manner, the sheet S is discharged to the discharge portion 9 provided in the upper surface of the apparatus mainframe through a pair of discharge rollers 8.

Figure 4:
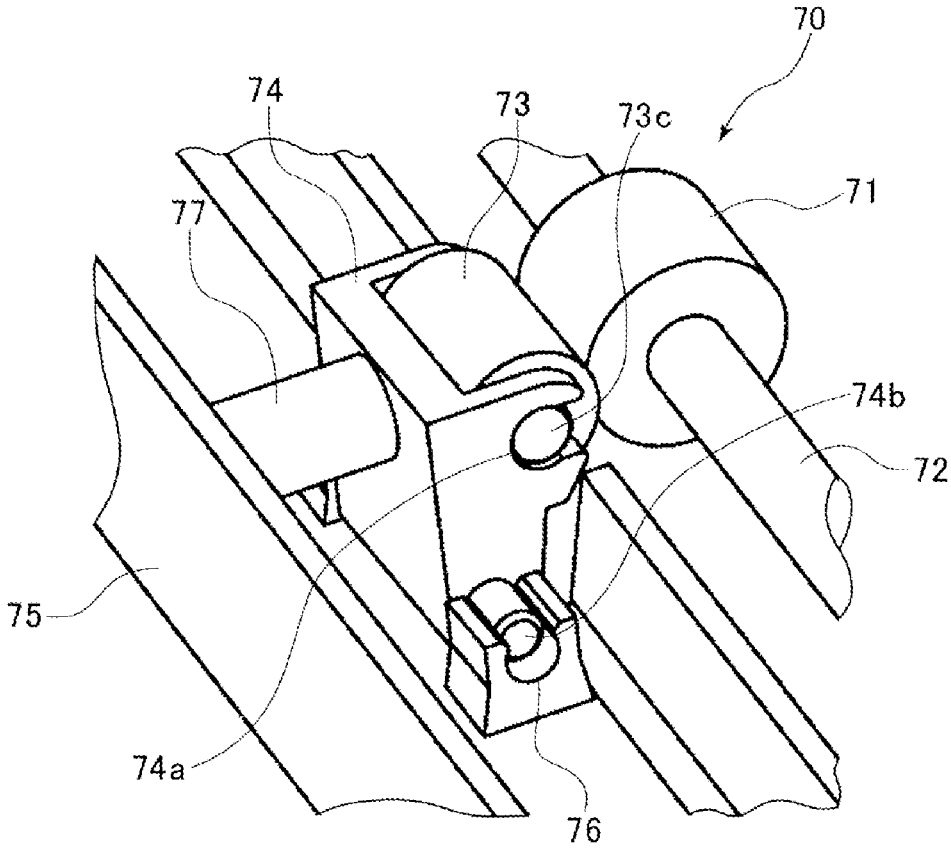
FIG. 4 is a first diagram illustrating a configuration of a pair of intermediate conveying rollers provided in the sheet conveying apparatus.

Next, a configuration of the pair of intermediate conveying rollers 70 provided in the second sheet conveying portion 70A will be described with reference to FIG. 4. As illustrated in FIG. 4, the pair of intermediate conveying rollers 70 includes an intermediate conveying roller 71 as a first rotating member and a subsidiary intermediate conveying roller 73 as a second rotating member making press contact with the intermediate conveying roller 71. In addition, an intermediate conveying roller shaft 72 where the intermediate conveying roller 71 is attached is rotatably driven by a driving unit (not illustrated).

The subsidiary intermediate conveying roller holder 74 rotatably supports the subsidiary intermediate conveying roller 73. The subsidiary intermediate conveying roller 73 is rotatable such that the subsidiary intermediate conveying roller shaft 73*c* is supported by a subsidiary intermediate conveying roller bearing 74*a* formed in the subsidiary intermediate conveying roller holder 74. The subsidiary intermediate conveying roller holder 74 is pivotable such that a subsidiary intermediate conveying roller holder pivot shaft 74*b* is supported by a subsidiary intermediate conveying roller holder pivot bearing 76 provided in an outer intermediate guide 75. In addition, the subsidiary intermediate conveying roller 73 is biased by a subsidiary intermediate conveying roller spring 77 through the subsidiary intermediate conveying roller holder 74 to make press contact with the intermediate conveying roller 71.

Here, as illustrated in FIG. 5 which illustrates the pair of intermediate conveying rollers 70 as seen from the subsidiary intermediate conveying roller 73 side in FIG. 2, the intermediate conveying roller 71 (71*a* and 71*b*) and the subsidiary intermediate conveying roller 73 (73*a* and 73*b*) are arranged in the outer sides in the axial direction with respect to the subsidiary feeding roller 62 (62*a* and 62*b*). That is, the pair of intermediate conveying rollers 70 is arranged in positions corresponding to both lateral sides in a width direction of the subsidiary feeding roller 62 in a sheet conveyance direction.

In addition, the subsidiary intermediate conveying roller 73 which makes press contact with the intermediate conveying roller 71 as a first rotating member which rotates in the sheet conveyance direction is arranged with an inclination toward the center of the sheet S in a width direction. In other words, the subsidiary intermediate conveying rollers 73 are inclined such that the sheet is conveyed toward the center of the sheet conveying path R in a width direction. In addition, a sheet conveying path R1 including an inner intermediate guide 110 and the outer intermediate guide 75 is provided between the feeding roller 60 and the subsidiary feeding roller 62 as a rotating member of the sheet feeding apparatus 1C and the pair of intermediate conveying rollers 70 as illustrated in FIG. 2.

A sheet conveying path R including a curved inner pre-registration guide 111 and an outer pre-registration guide 112 is provided between the pair of intermediate conveying rollers 70 provided in the downstream side of the sheet feeding apparatus 1C and the pair of registration rollers 80. That is, the sheet conveying path R is curved from the pair of intermediate conveying rollers 70 including the inner pre-registration guide 111 as an inner guide member and the outer pre-registration guide 112 as an outer guide member to the pair of registration rollers 80.

In addition, as described above, the sheet S separated one by one by the sheet feeding apparatus 1C is guided to the inner intermediate guide 110 and the outer intermediate guide 75 and is sent to the pair of intermediate conveying rollers 70. In addition, when the sheet arrives at the pair of intermediate conveying rollers 70, the sheet S is nipped between the separation pad 40 and the subsidiary feeding roller 62. As a result, the sheet S is extracted and conveyed by the pair of intermediate conveying rollers 70 against a conveyance resistance.

Figure 5A:
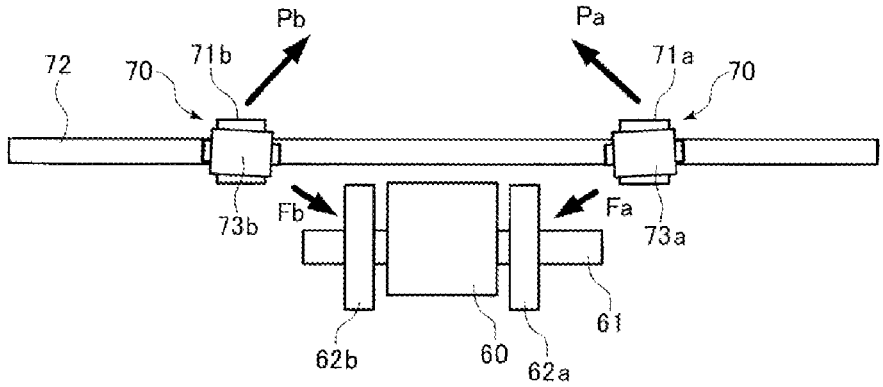
FIG. 5A is a second diagram illustrating a configuration of the pair of intermediate conveying rollers.
Figure 5B:
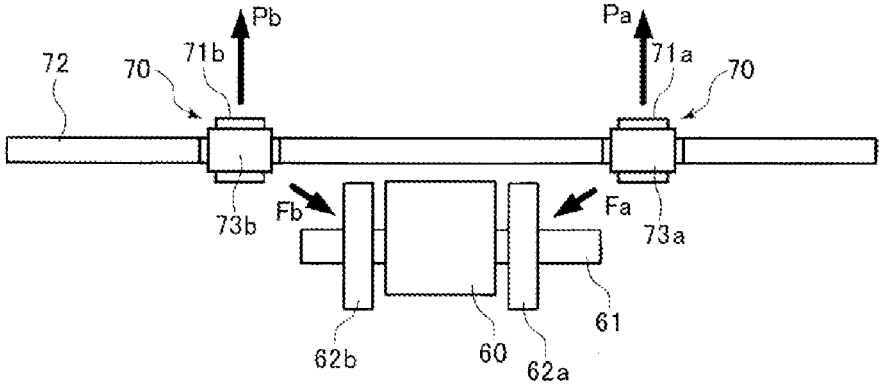
FIG. 5B is a second diagram illustrating a configuration of the pair of intermediate conveying rollers.
Figure 5C:
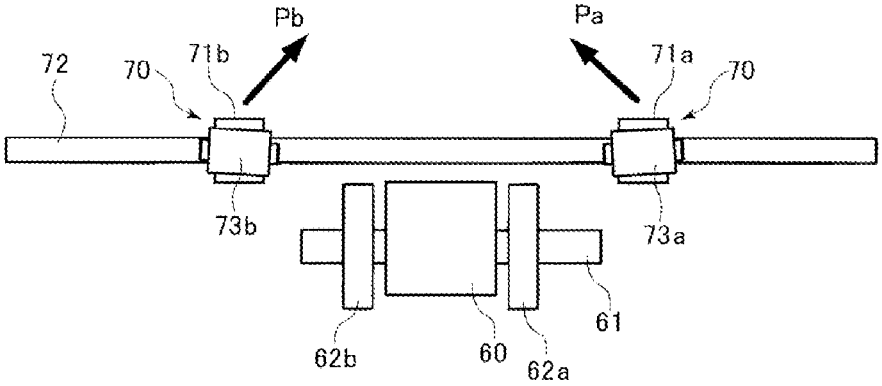
FIG. 5C is a second diagram illustrating a configuration of the pair of intermediate conveying rollers.

Here, as illustrated in FIGS. 5A to 5C, the intermediate conveying roller 71*a* and the subsidiary intermediate conveying roller 73*a* are arranged in an outer side of the subsidiary feeding roller 62*a* in an axial direction (outer side in a width direction) in the sheet conveyance direction as described above. Similarly, the intermediate conveying roller 71*b* and the subsidiary intermediate conveying roller 73*b* are arranged in an outer side of the subsidiary feeding roller 62*b* in a width direction. Therefore, the conveyance resistance force generated by the conveyance resistance is directed along arrows Fa and Fb.

That is, the conveyance resistance force indicated by the arrow Fa is directed from the nip between the intermediate conveying roller 71*a* and the subsidiary intermediate conveying roller 73*a* to the nip between the separation pad 40 and the subsidiary feeding roller 62*a*. Similarly, the conveyance resistance force indicated by the arrow Fb is directed to the nip between the intermediate conveying roller 71*b* and the subsidiary intermediate conveying roller 73*b* and the nip between the separation pad 40 and the subsidiary feeding roller 62*b*.

Figure 6:
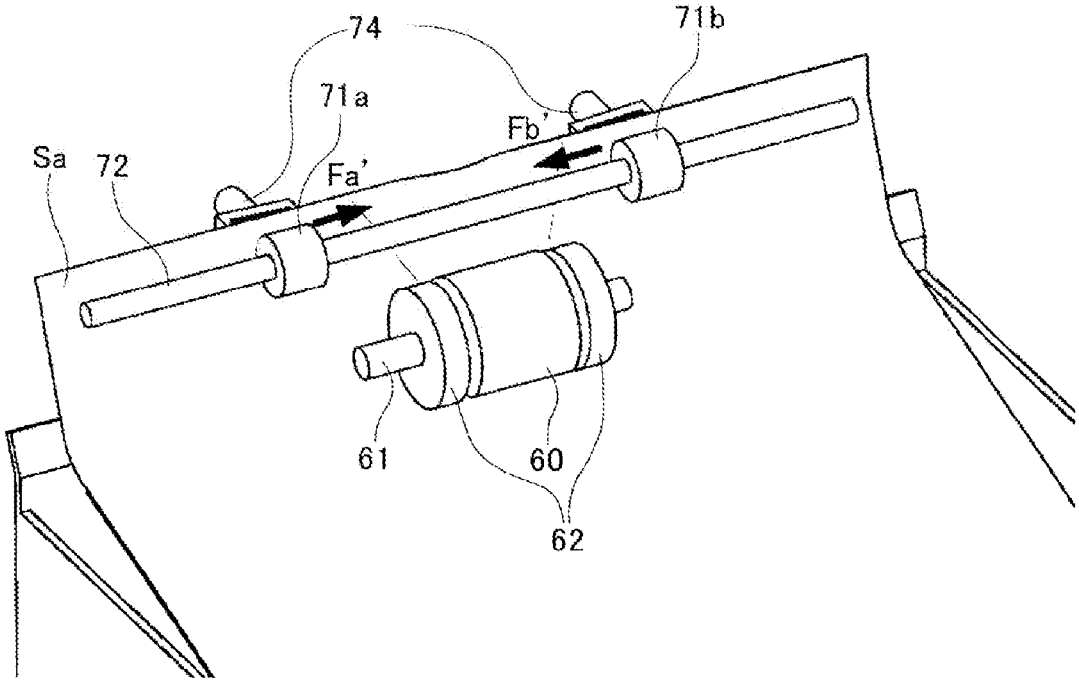
FIG. 6 is a diagram illustrating that a sheet undulates during the sheet feeding.

As a result, the conveyance resistance forces Fa and Fb are applied as a force directed to the center of the sheet S in a width direction. In addition, by virtue of the conveyance resistance forces Fa and Fb in this direction, forces Fa' and Fb' directed to the center of the sheet S in a width direction between the intermediate conveying rollers 71*a* and 71*b* are applied to the sheet S as illustrated in FIG. 6.

Here, the sheet S is nipped between the intermediate conveying roller 71 and the subsidiary intermediate conveying roller 73. Therefore, even when the forces Fa' and Fb' are applied by the conveyance resistance forces Fa and Fb, it is difficult to move the sheet S to the directions Fa' and Fb' by virtue of the nipping force between the intermediate conveying roller 71 and the subsidiary intermediate conveying roller 73. That is, it is difficult to compress the sheet S toward the center in a width direction. Therefore, the undulation amount of the sheet S is small.

However, the conveyance state of the sheet S changes depending on the conveyance resistance of the sheet S and the inclination of the subsidiary intermediate conveying roller 73. Next, description will be made for a conveyance state of the sheet S that changes depending on the conveyance resistance of the sheet S and the inclination of the subsidiary intermediate conveying roller 73.

First, description will be made for a state of the sheet S in a case where the conveyance resistance exists in the sheet S, but there is no inclination in the subsidiary intermediate conveying roller 73, that is, a case where the axial line of the subsidiary intermediate conveying roller 73 is perpendicular to the conveyance direction of the sheet S.

Under this state, as illustrated in FIG. 5B, the conveyance force indicated by arrows Pa and Pb of the pair of intermediate conveying rollers 70 is applied in the sheet conveyance direction. In this case, the forces Fa' and Fb' are reduced. For this reason, a smaller undulation of the sheet S is generated. However, since the pair of intermediate conveying rollers 70 is not inclined, the conveyance force toward the center in a width direction is not generated.

In addition, as described above, the sheet conveying path R from the pair of intermediate conveying rollers 70 to the pair of registration rollers 80 is curved. For this reason, the exterior stiffness of the sheet S is reinforced. Therefore, the small undulation of the sheet S generated in this manner is removed by stretching the sheet S in the width direction in the downstream of the pair of intermediate conveying rollers 70. As a result, as the trailing end of the sheet S passes through the pair of intermediate conveying rollers 70, the sheet S is conveyed by the pair of registration rollers 80 and rapidly approaches the inner pre-registration guide 111. As a result, the sheet S is bumped against the inner pre-registration guide 111 so as to generate a bumping noise.

Next, description will be made for a state of the sheet S in a case where the conveyance resistance does not exist in the sheet S, and the subsidiary intermediate conveying roller 73 is inclined toward the center of the sheet S in a width direction. Under a state that there is no conveyance resistance in this manner, the forces Fa' and Fb' are not applied to the sheet S. Meanwhile, a conveyance force generated by the pair of intermediate conveying rollers 70 is directed to the center of the sheet S in a width direction indicated by the arrows Pa and Pb of FIG. 5C.

In addition, a state that the conveyance resistance does not exist in the sheet S, for example, refers to a state that the subsidiary feeding roller 62 is separated from the separation pad 40 after the sheet S is isolated. As a result, the sheet S is conveyed without being nipped between the subsidiary feeding roller 62 and the separation pad 40, that is, without a conveyance resistance.

Since the sheet conveying path R is curved from the pair of intermediate conveying rollers 70 to the pair of registration rollers 80 as described above, the exterior stiffness of the sheet S is reinforced. Therefore, a strong force is necessary to undulate the sheet S. For this reason, the forces Fa' and Fb' caused by the conveyance resistance for undulating the sheet S do not exist, and it is difficult to sufficiently undulate the sheet S only using the forces Pa and Pb generated by inclining the subsidiary intermediate conveying roller 73.

Therefore, even in this case, as the trailing end of the sheet S passes through the pair of intermediate conveying rollers 70, the sheet S is conveyed to the pair of registration rollers 80 and rapidly approaches the inner pre-registration guide 111. As a result, the sheet S is bumped against the inner pre-registration guide 111 so as to generate a bumping noise.

Finally, description will be made for a state of the sheet S in a case where the conveyance resistance exists in the sheet S, and the subsidiary intermediate conveying roller 73 is inclined toward the center of the sheet S in a width direction. That is, description will be made for a state of the sheet S in a case where the sheet conveyance direction of the pair of intermediate conveying rollers 70 is set to the center in a width direction.

In this manner, if the conveyance resistance exists in the sheet S, the forces Fa' and Fb' are applied to the sheet S, and the sheet S is slightly undulated as illustrated in FIG. 5A. In addition, if the pair of intermediate conveying rollers 70 is inclined, a force is generated in the sheet S toward the center in a width direction as indicated by the arrows Pa and Pb, and the sheet S is undulated.

Here, the sheet conveying path R is curved from the pair of intermediate conveying rollers 70 to the pair of registration rollers 80. However, since the sheet S is undulated by the conveyance resistance even when the sheet conveying path R is curved in this manner, the sheet S is further undulated by the subsidiary intermediate conveying roller 73. That is, if the conveyance resistance exists in the sheet S, and the subsidiary intermediate conveying roller 73 is inclined, the sheet S can be significantly undulated in the downstream of the pair of intermediate conveying rollers 70 due to both the conveyance resistance of the sheet S and the subsidiary intermediate conveying roller 73.

Figure 7:
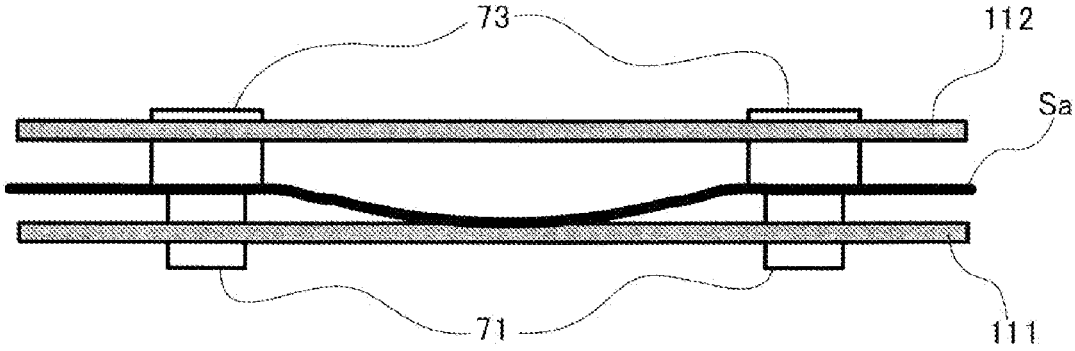
FIG. 7 is a first diagram illustrating a state that a sheet has undulated.

FIG. 7 is a diagram illustrating a state that the sheet S is undulated in this case. In addition, FIG. 7 is a schematic diagram illustrating a cross-section taken along the line L of FIG. 2 as seen from the top. Referring to FIG. 7, the sheet S is significantly undulated between the outer pre-registration guide 112 and the inner pre-registration guide 111 in a downstream of the pair of intermediate conveying rollers 70. Here, when such significant undulation occurs, a part of the sheet makes contact with the inner pre-registration guide 111.

In addition, while a part of the undulated sheet S makes contact with the inner pre-registration guide 111, the sheet S is guided by the inner pre-registration guide 111 and the outer pre-registration guide 112 into the pair of registration rollers 80. Since the sheet conveying path R is curved from the pair of intermediate conveying rollers 70 to the pair of registration rollers 80 as described above, the undulation of the sheet S is alleviated by stretching as the sheet S approaches the pair of registration rollers 80. For this reason, the undulation of the sheet S does not affect the transfer operation.

In addition, a conveyance velocity of the pair of intermediate conveying rollers 70 is set to be faster than a conveyance velocity of the pair of registration rollers 80 as described above. Therefore, while the sheet S is nipped and conveyed by both the pair of intermediate conveying rollers 70 and the pair of registration rollers 80, the sheet S in which the undulation is alleviated near the upstream side of the pair of registration rollers 80 is conveyed along the outer pre-registration guide 112.

Figure 8:
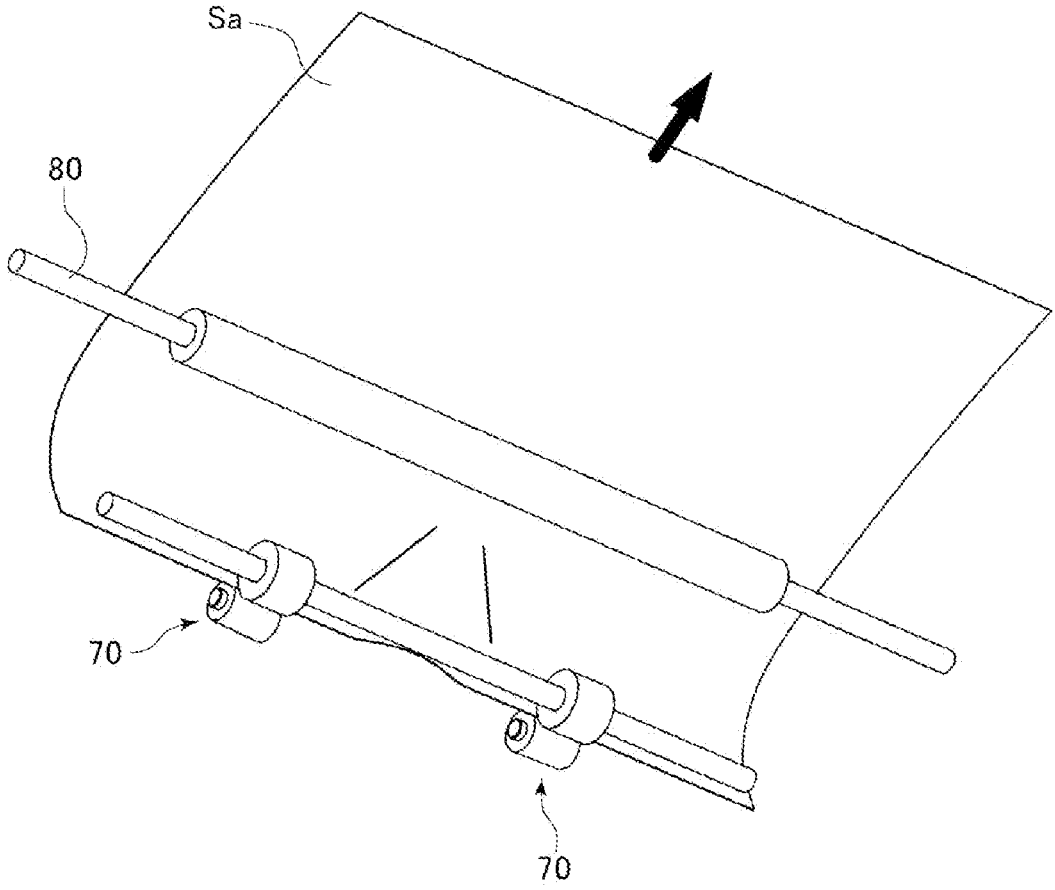
FIG. 8 is a second diagram illustrating a state that a sheet has undulated.

The trailing end of the sheet S is undulated immediately before passing through the pair of intermediate conveying rollers 70 as illustrated in FIG. 8. In addition, since the sheet S starts to be conveyed to the pair of registration rollers 80 as soon as the trailing end passes through the pair of intermediate conveying rollers 70, the sheet S is delivered to the inner pre-registration guide 111 at a burst. However, the trailing end of the sheet S is undulated, and a part of the undulation sheet makes contact with the inner pre-registration guide 111.

For this reason, the sheet S is not bumped against the inner pre-registration guide 111 at a burst but slowly approaches. In this manner, since the sheet S slowly approaches the inner pre-registration guide 111, the bumping noise generated between the inner guide and the sheet when trailing end of the sheet passes through the pair of intermediate conveying rollers 70 can be alleviated.

As described above, according to the present embodiment, the pair of intermediate conveying rollers 70 is arranged in positions corresponding to both lateral sides of the subsidiary feeding roller 62*a* in a width direction, and the subsidiary intermediate conveying rollers 73 are inclined to the center of the sheet S such that the sheet conveyance force is directed to the center of the sheet in a width direction. As a result, when the sheet S is extracted and conveyed by the second sheet conveying portion 70A, the sheet is undulated in the width direction and can make contact with the inner pre-registration guide 111 of the sheet conveying path R where the sheet S is curved. As a result, a force generated by the contact between the sheet S and the inner pre-registration guide 111 can be alleviated when the trailing end of the sheet S passes through the pair of intermediate conveying rollers 70. In addition, the bumping noise generated between the sheet and the inner pre-registration guide can be alleviated when the trailing end of the sheet passes through the pair of intermediate conveying rollers 70.

Although the sheet S is undulated to make a single peak in FIGS. 6 and 7 described above, the invention is not limited thereto. The sheet S may be undulated to make a plurality of peaks depending on a condition such as a type of sheet, temperature, and humidity.

Figure 9:
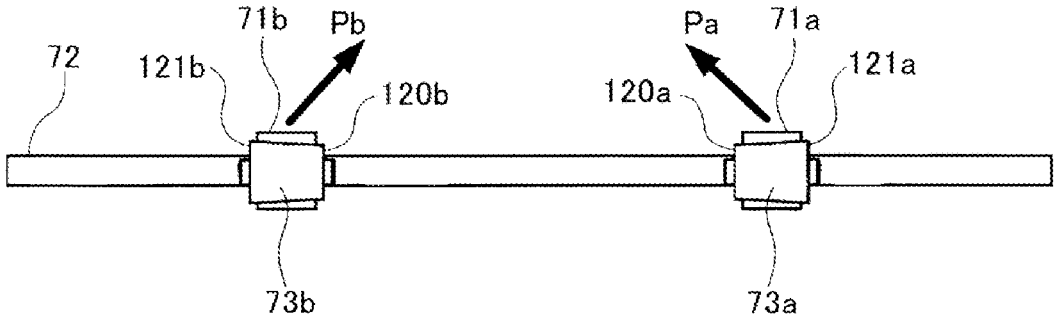
FIG. 9 is a diagram illustrating another configuration of a pair of intermediate conveying rollers.

Although description has been made for a case where the subsidiary intermediate conveying rollers 73 are inclined to the center of the sheet S such that the sheet S can be undulated in the downstream of the pair of intermediate conveying rollers 70, the invention is not limited thereto. For example, the subsidiary intermediate conveying roller 73 may be formed in a tapered shape such that outer diameters 121*a* and 121*b* of the external sides in the width direction are larger than outer diameters 120*a* and 120*b* of the center side in the width direction as illustrated in FIG. 9.

If the subsidiary intermediate conveying roller 73 has a tapered shape in this manner, a conveyance velocity of the outer side of the subsidiary intermediate conveying roller 73 is faster than that of the inner side thereof. As a result, the forces Pa and Pb directed to the center of the sheet S in a width direction are generated.

In this manner, since the subsidiary intermediate conveying roller 73 has a tapered shape, and the forces Pa and Pb directed to the center of the sheet S in a width direction are generated by a dimension difference between the inner side and the outer side of the subsidiary intermediate conveying roller 73, the sheet S is caused to undulate using a simpler configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-066001, filed Mar. 24, 2011 which is hereby incorporated by reference herein in its entirety.

What is claimed is:

1. A sheet conveying apparatus comprising:

a first sheet conveying portion including a rotating member configured to convey a sheet;

a second sheet conveying portion that is arranged on downstream of the first sheet conveying portion, includes a plurality of pairs of rotating members provided in a width direction perpendicular to a sheet conveyance direction, and conveys the sheet from the first sheet conveying portion using the plurality of pairs of the rotating members; and a sheet conveying path that includes an outer guide member and an inner guide member facing each other and is curved to guide the sheet conveyed by the second sheet conveying portion to a downstream side, wherein the plurality of pairs of the rotating members of the second sheet conveying portion are arranged in positions corresponding to both lateral sides in a width direction of the rotating member of the first sheet conveying portion in a sheet conveyance direction when the sheet is conveyed by the second sheet conveying portion, and a sheet conveyance force caused by the plurality of pairs of the rotating members of the second sheet conveying portion is directed to a center of the sheet conveying path in a width direction.

2. The sheet conveying apparatus according to claim 1, wherein the pair of rotating members of the second sheet conveying portion includes a first rotating member rotating in a sheet conveyance direction and a second rotating member abutting on the first rotating member with an inclination toward the center of the sheet conveying path in a width direction relative to the sheet conveyance direction.

3. The sheet conveying apparatus according to claim 1, wherein the second sheet conveying portion includes a first rotating member rotating in a sheet conveyance direction and a second rotating member that abuts on the first rotating member and is tapered such that an outer diameter of an outer side in a width direction is larger than an outer diameter of a center side in a width direction.

4. The sheet conveying apparatus according to claim 1, wherein the first sheet conveying portion includes the rotating member, a subsidiary roller coaxially provided in an outer side of the rotating member in a width direction, and a frictional separation member that presses a sheet in press contact with the subsidiary roller, and the plurality of pairs of the rotating members of the second sheet conveying portion are arranged in positions corresponding to both lateral sides in a width direction of the subsidiary roller in a sheet conveyance direction.

5. The sheet conveying apparatus according to claim 4 comprising:

a sheet loading portion that loads a sheet, wherein the rotating member of the first sheet conveying portion serves as a feeding roller configured to feed the sheet loaded on the sheet loading portion, and the subsidiary roller serves as a subsidiary feeding roller configured to press the sheet after the sheet is fed by the feeding roller in press contact with the frictional separation member.

6. An image forming apparatus comprising:

the sheet conveying apparatus according to claim 1; and an image forming portion that forms an image on a sheet conveyed by the sheet conveying apparatus.

* * * * *